US005423460A

United States Patent [19]

Thomann

[11] Patent Number: 5,423,460

[45] Date of Patent: Jun. 13, 1995

[54] SPRAY PUMP

[75] Inventor: Günter Thomann, Weisweil, Germany

[73] Assignee: Frimec Fritz Meckenstock GmbH & Co., Wuppertal, Germany

[21] Appl. No.: 30,213

[22] PCT Filed: Sep. 5, 1991

[86] PCT No.: PCT/EP91/01688

§ 371 Date: Mar. 2, 1993

§ 102(e) Date: Mar. 2, 1993

[87] PCT Pub. No.: WO92/04128

PCT Pub. Date: Mar. 19, 1992

[30] Foreign Application Priority Data

Sep. 6, 1990 [DE] Germany ..... 40 28 286.4
Jan. 10, 1991 [DE] Germany ..... 41 00 558.9
Jun. 20, 1991 [DE] Germany ..... 9107580 U

[51] Int. Cl.[6] ..... B67D 5/40
[52] U.S. Cl. ..... 222/382; 222/383.3
[58] Field of Search ..... 222/382, 383, 377, 464; 239/333

[56] References Cited

U.S. PATENT DOCUMENTS

| | | | |
|---|---|---|---|
| 2,109,589 | 3/1938 | Horwitt et al. | 239/333 |
| 2,626,185 | 1/1953 | Roselund | 239/333 |
| 3,092,330 | 6/1963 | Bidenour et al. | 222/383 |
| 4,120,430 | 10/1978 | French | 222/383 |
| 4,209,159 | 6/1980 | Becker et al. | 248/430 |
| 4,219,159 | 8/1980 | Wesner | 239/343 |
| 4,257,539 | 3/1981 | Cary et al. | 222/383 |
| 4,640,444 | 2/1987 | Bundschuh | 222/383 |
| 4,944,431 | 7/1990 | Blake | 222/383 |
| 4,958,754 | 9/1990 | Dennis | 222/382 |

FOREIGN PATENT DOCUMENTS

| | | | |
|---|---|---|---|
| 0224610 | 6/1987 | European Pat. Off. . | |
| 2042690 | 3/1972 | Germany . | |
| 7330743 | 7/1974 | Germany . | |
| 7927316 | 1/1980 | Germany . | |
| 2538971 | 3/1980 | Germany . | |
| 3005779 | 1/1981 | Germany . | |
| 3314020 | 10/1984 | Germany . | |
| 2076076 | 11/1981 | United Kingdom . | |
| 87/01618 | 3/1987 | WIPO | 239/333 |
| 90/14167 | 11/1990 | WIPO | 222/383 |

*Primary Examiner*—Andres Kashnikow
*Assistant Examiner*—Philippe Derakshani
*Attorney, Agent, or Firm*—Martin A. Farber

[57] ABSTRACT

A hand lever-actuated spray pump (1) having a pump chamber (4) which has an inlet (7) and an outlet valve (8), furthermore having a (sprung) pump piston (6) which interacts with a pump cylinder (5), a lever-like actuating handle (2) and an antechamber (20) which is connected to the pump cylinder (5), is arranged upstream of the pump cylinder (5) and into which there opens a suction tube (22); to achieve a practical and simple solution, it is proposed that the pump piston (6), the pump cylinder (5) and the antechamber (20) are arranged in axial extension of the outlet nozzle (13) and are supported in the pump head, the pump piston (6) being held captive in the fixed outlet nozzle (13), the suction tube (22) opening approximately at right angles into the antechamber (20) and the spring (35) acting directly on the hand lever (10).

36 Claims, 14 Drawing Sheets

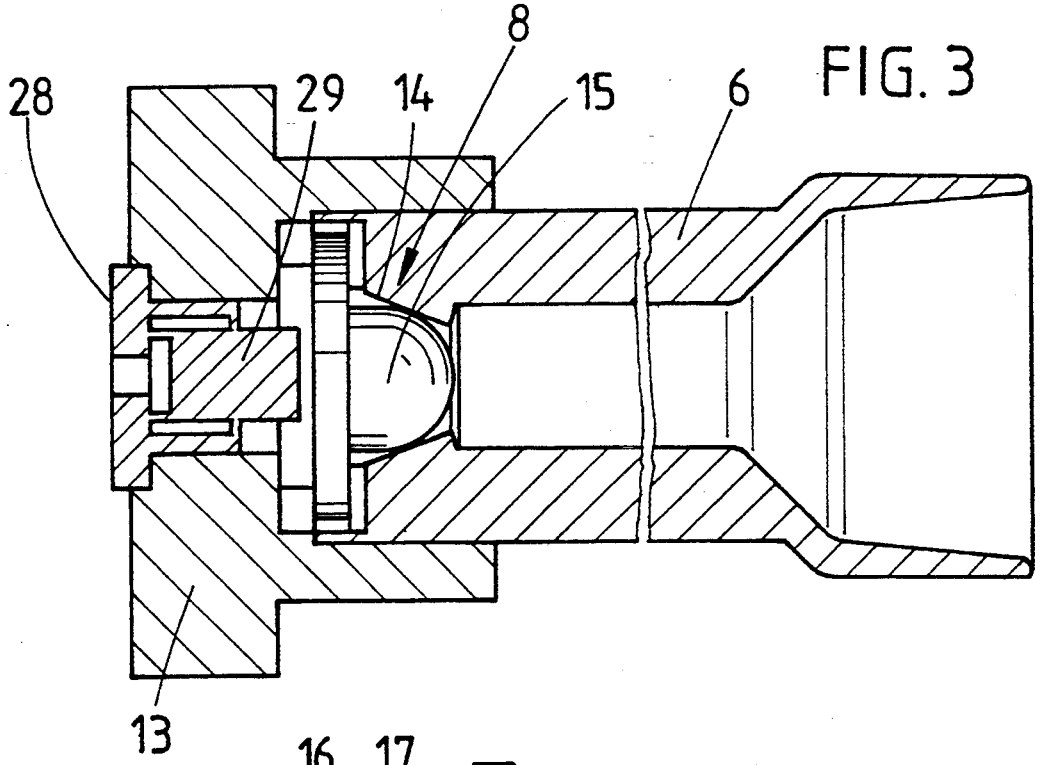
FIG. 3
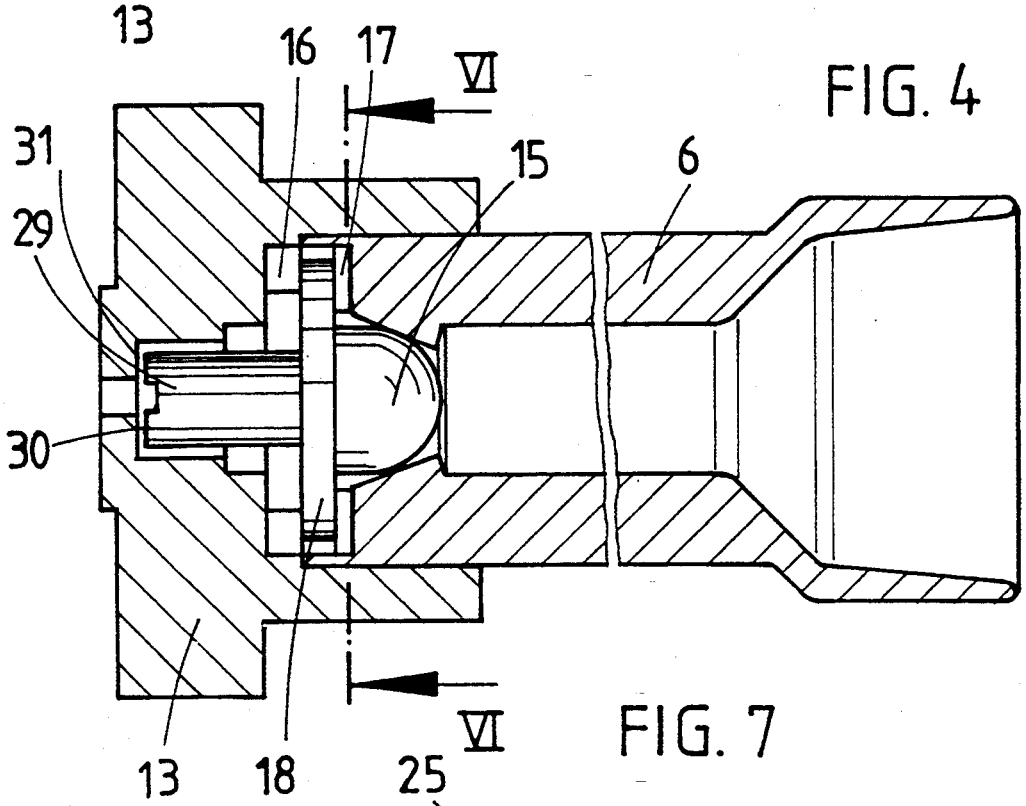
FIG. 4
FIG. 7
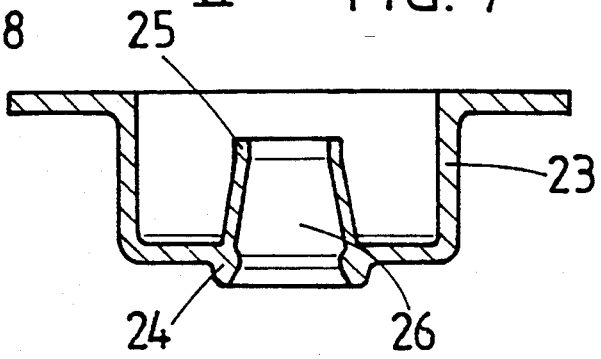

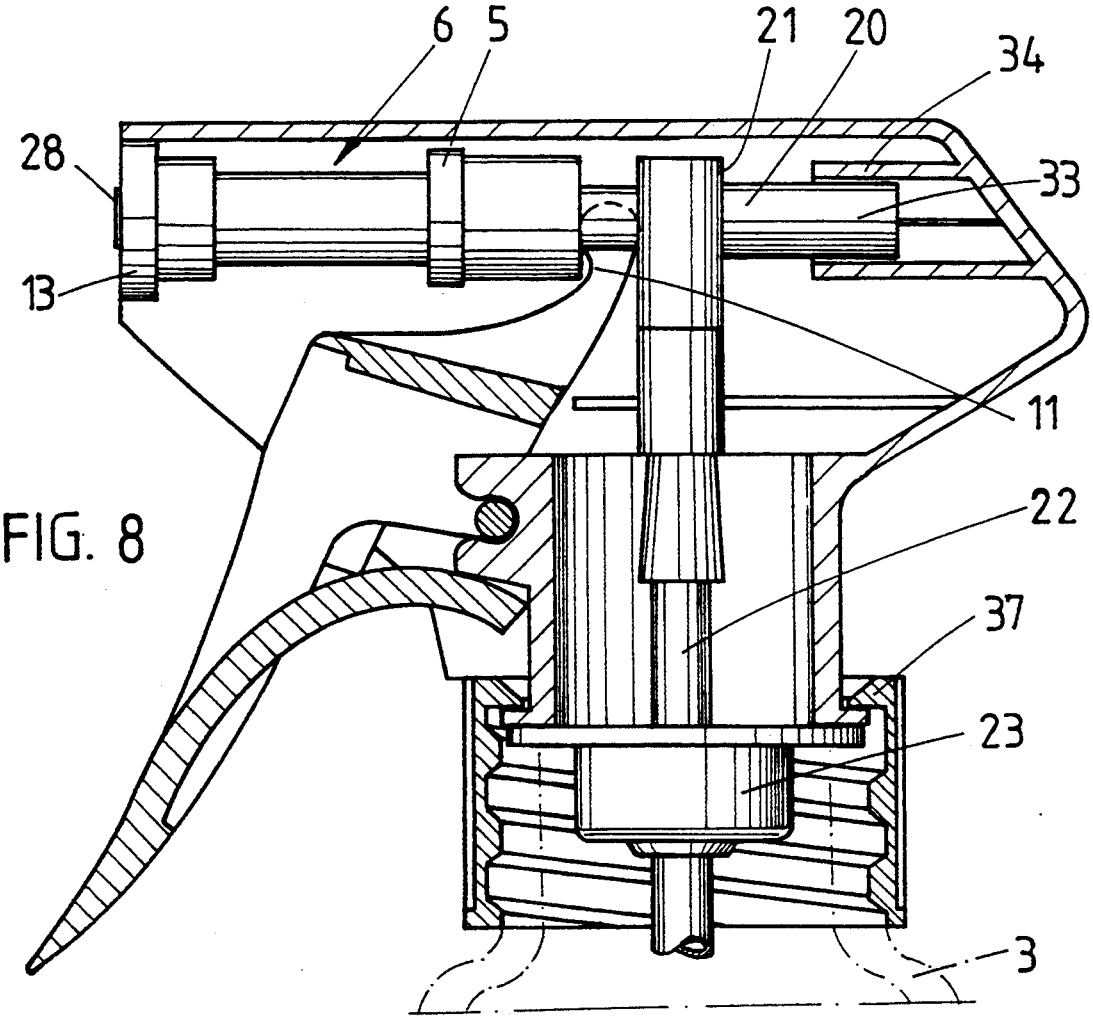
FIG. 8
FIG. 10
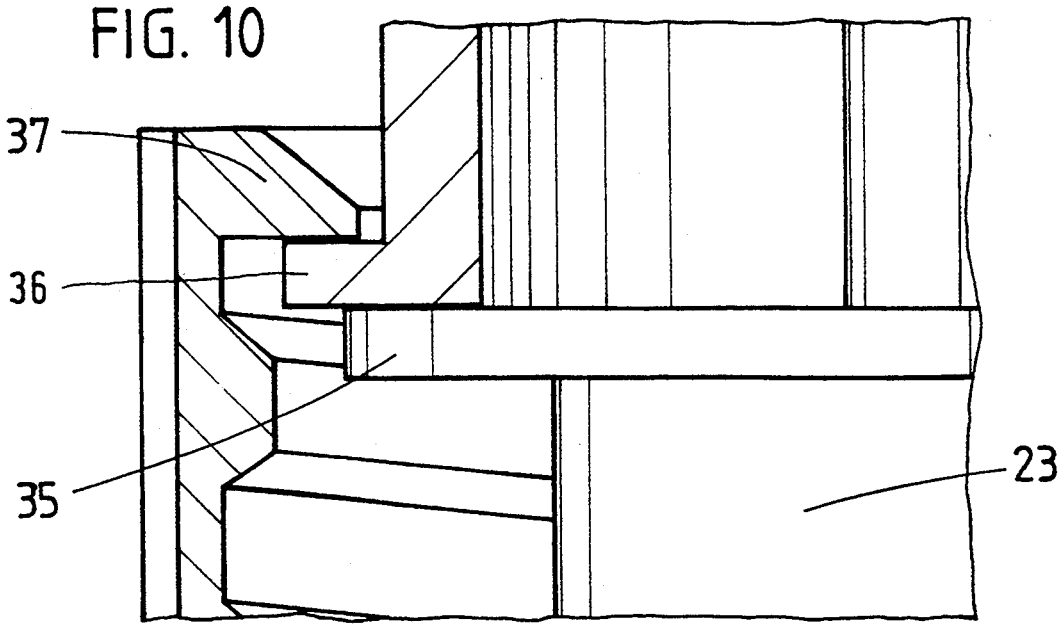

FIG. 15
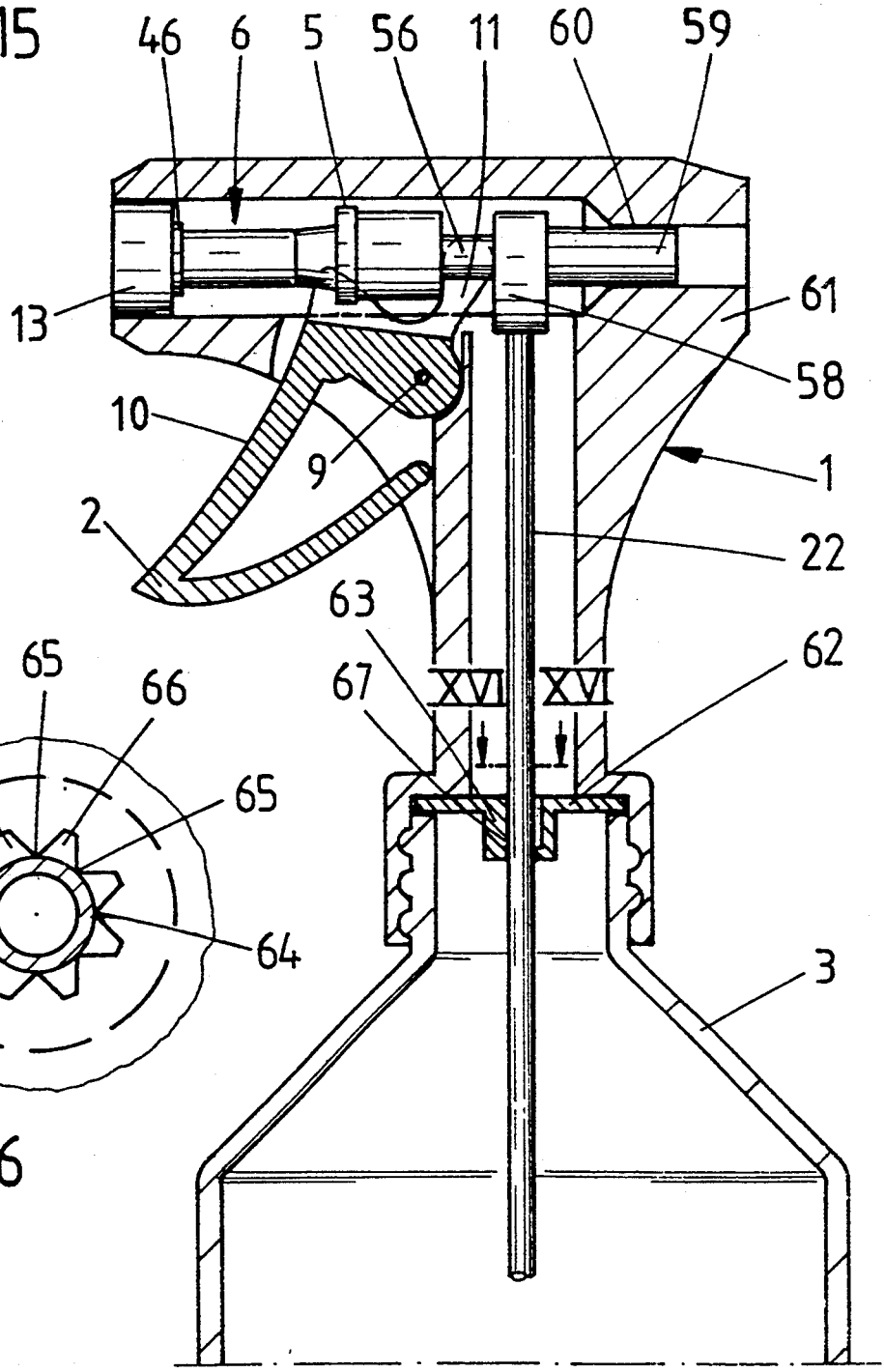
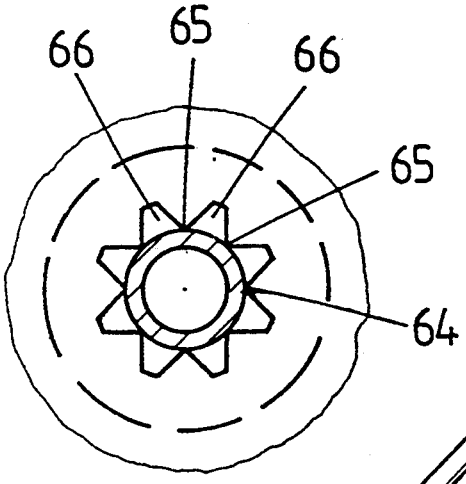
FIG. 16

SPRAY PUMP

FIELD AND BACKGROUND OF THE INVENTION

The invention relates to a hand lever-actuated spray pump having a pump chamber which has an inlet and an outlet valve, furthermore having a pump piston which interacts with a pump cylinder, a lever-like actuating handle and an antechamber which is connected to the pump cylinder, is arranged upstream of the pump cylinder and into which there opens a suction tube, it being possible for the pump cylinder to be moved relative to the pump piston in order to carry out a pumping operation and it being possible to effect a return movement via a spring.

Spray pumps of this kind have already been disclosed in various designs. In this connection, attention is drawn, merely by way of example, to U.S. Pat. No. 4,219,159, German Offenlegungsschrift 2,538,971 and German Offenlegungsschrift 3,314,020. In these known spray pumps, the hand lever acts on the pump piston and displaces it in the pump cylinder. The hand lever is furthermore hinged on the upper part of the pump head via a swivel joint. Provided in the pump cylinder and acting on the pump piston there is in each case a return spring in the pump casing.

In connection with the prior art, attention should furthermore be drawn to German Utility Model 7,330,743, German Offenlegungsschrift 3,005,779 and U.S. Pat. No. 4,120,430. The said utility model discloses a hand lever-actuated spray pump with a pump piston, a pump cylinder and an antechamber into which the suction tube opens. The suction tube is here arranged in axial extension of the pump cylinder and the antechamber. Adjoining this, the suction tube has a bend and then extends vertically downwards into the storage space. A (two-point) support of the functional parts of the pump in the pump head is not provided. On the contrary, the suction tube must assume a supporting function. In the event of a pumping movement, an unfavourable displacement of the suction tube results in each case. The arrangement known from this prior art is furthermore also unfavourable in that the cylinder and the pump piston must be spaced apart by a spring extending between them. In the subject-matter of U.S. Pat. No. 4,120,430, the spray nozzle is firmly connected to the movable pump cylinder. During each pumping operation, a displacement of the spray nozzle results and this gives an unfavourable impression in terms of handling.

Finally, attention is drawn as regards the prior art to GB-A-20 76 076. Here too, however, the spray nozzle is firmly connected to the movable pump piston. A displacement of the spray nozzle likewise results during each pumping operation.

Starting from the last-mentioned prior art, the invention sets itself the object of configuring and further developing the known hand lever-actuated spray pump in such a way that, in combination with a construction of maximum simplicity, a high degree of practicality is achieved.

SUMMARY OF THE INVENTION

This object is achieved in the case of the invention specified in claim 1. Here, the configuration is such that the pump piston, the pump cylinder and the antechamber are arranged in axial extension of the outlet nozzle and are supported in axially movable fashion in the pump head (separately from a retention device in the region of the outlet nozzle), the pump piston being held captive in a fixed outlet nozzle, that the suction tube opens approximately at right angles into the antechamber and that the spring acts directly on the hand lever. The essential functional parts, the pump piston, the pump cylinder and the antechamber into which the suction tube opens are arranged directly behind the spray nozzle in the axial direction. This arrangement is furthermore also supported in the pump head at a point which represents an axial extension of the spray nozzle. Together with the spray nozzle, this gives two-point suspension or support essentially along one axis in the pump head. As regards assembly, the parts can simply be plugged together; an intermediate spring is not provided. On the contrary, the spring acting directly on the hand lever is arranged outside the said functional parts. In a further development, it is provided that the outlet valve is arranged between the outlet nozzle and the pump piston. However, as an alternative, the outlet valve can also be arranged on its own as an insert in the pump piston itself. As regards the first-mentioned development, this provides the advantageous possibility of clamping the outlet valve between the outlet nozzle and the pump piston. This is, in turn, also advantageous in particular as regards assembly, permitting simple plug-in assembly. In detail, the pump piston is preferably of a design which has a widening outlet region, widening, for example, in the form of a funnel, with a sealing part of the outlet valve seated in sealing fashion under prestress in the region of the widening. The outlet valve has a fixing collar and a sealing part. In this arrangement, the sealing part is designed to resemble a spherical cap. It can be solid, preferably composed of a soft plastic, the same plastic of which the whole valve part is composed. The desired prestress can be achieved by a greater axial length of the sealing part than corresponds to the actual distance between the sealing surface in the pump piston and the clamping point of the fixing collar. It is furthermore provided that an opening limitation for the outlet valve is formed, i.e. that the outlet valve can only move to a limited extent in its installation position. The opening limitation is preferably achieved by a limiting part integrally formed on the outlet valve. The outlet valve is of integral design with the limiting part. It can be a cylindrical part formed axially opposite to the spherical cap-shaped part. It is also preferred here if channels are formed on the front face of the limiting part in a direction facing the outlet nozzle. When the outlet valve opens, the front face moves into contact with, for example, the nozzle part, and the channels are completely or partially closed. The emerging liquid is forced to pass through and the effect of the swirl chamber customarily present in such spray pumps is thus achieved. Accordingly, the channels are designed in such a way that, upon opening of the valve, they produce the swirling effect. Clamping can furthermore preferably be achieved by webs which are formed both in the nozzle part and in the forward region of the pump piston, in each case in a circumferential edge region. These webs can also be formed in each case on only one of the said parts. The clamping of the fixing collar is achieved between the webs and the counterwebs or counterpart. In a further development, it is provided that the suction tube of the spray pump passes through a U packing surrounding the latter radially. In this context, it is provided that the U packing rests against two axially spaced regions on the suction tube with the interposition of a region spaced from the suction tube. In this arrangement, the U packing is of cup-shaped design overall, the cup orifice facing the pump chamber or antechamber. The first of the axially spaced regions is preferably arranged in the cup bottom, for instance, and the second region is axially offset towards the antechamber. Preferably, it is still situated within the cup orifice. The seal regions are matched to the suction tube in such a way that contact results in both seal regions, that is to say there is a certain—if only slight—oversizing of the suction tube. In the case of such an embodiment, the surprising result achieved is that, during a pump actuation, in which the suction tube moves away from the axis of its rest position, the resulting tilting produces a lack of tightness, which allows additional air to flow into the storage region of the spray pump from outside. Thus, when a pump actuation has been carried out, with the hand lever stressed, an intentional lack of tightness is simultaneously achieved which allows additional air to flow into the storage space. With the spray pump unactuated, on the other hand, tightness is achieved and, as a result, the spray pump can then also be turned upsidedown without liquid flowing out past the U packing. In detail, the U packing is designed to rest against the immersion tube over a very short axial length in one region and over a longer axial length in the other region. The first region is preferably the one situated in the interior of the cup and the other region is the one formed essentially in the region of the cup bottom. The axial length in one region is a few tenths of a millimetre and, in the other region, is about 2 to 3 millimetres, these merely being preferred dimensions. In an alternative embodiment to the initially described fixing of the pump piston in the fixed outlet nozzle part, it is possible to provide that the pump piston is arranged in such a way that it can move slightly in the outlet nozzle part in order to open and close a valve at the nozzle in this arrangement, the outlet valve is, as before, preferably formed by the interaction between the pump piston and the outlet nozzle. The fixed outlet nozzle and the pump piston arranged in such a way that it can move slightly have parallel conical surfaces which interact to give the valve function. The conical surfaces both open towards the outlet nozzle. The conical surface of the pump piston is situated inside the conical surface of the outlet nozzle. When the pump piston is moved away from the outlet nozzle, the conical surface of the pump piston comes into sealing contact with the conical surface of the outlet nozzle. This occurs each time the pump cylinder is moved away from the outlet nozzle by the spring force. An entrainment effect is initially set up. Due to the increasing volume of the pump chamber, a vacuum is then formed, as a result of which the inlet valve of the pump chamber is opened and additional liquid is sucked into the pump chamber from the storage receptacle on which the spray pump is mounted, thus effecting refilling. The pump piston and the pump cylinder can be moved axially together, as a whole, in extension of an axis of the outlet nozzle in which the pump head is arranged. Adjoining the pump cylinder in a direction away from the outlet nozzle is a tubular element with an antechamber which tapers towards the inlet valve of the pump chamber. This embodiment is of general significance. Opening into this antechamber is a suction tube which forms the connection to the storage receptacle of a bottle or the like. In further axial extension of the antechamber, the latter is designed as a journal which is guided in a hole in the pump head. Upon actuation of the pump, the pump cylinder is moved axially together with the antechamber fixed thereon and the journal, although the journal remains held in the aforesaid hole in the pump head at all times. In accordance with a preferred embodiment, the suction tube connected via the antechamber is taken along during each movement of the pump cylinder. The suction tube, arranged approximately at right angles to a longitudinal axis of the pump piston, the pump cylinder and the antechamber, is accordingly in each case displaced concomitantly in the event of a pumping movement. This displacement movement of the suction tube is utilised in a special way according to the invention. Provided at the transition between the pump head and a storage receptacle is a seal element which, on the one hand, is clamped between the pump head and the storage receptacle and, on the other hand, surrounds the suction tube like a U packing. This U packing is designed in such a way that, upon displacement of the suction tube due to a pumping movement, an intentional lack of tightness results but that, in the state of rest of the suction tube, complete sealing is provided. During the displacement movement of the suction tube, up to the point at which the pump cylinder is in its forwardmost position nearest to the nozzle, a flow of additional air through the U packing into the storage receptacle is possible due to the intentionally achieved lack of tightness. On the other hand, due to the sealing provided in the condition of rest, it is not possible for liquid to flow out via the seal even if the spray pump is held upsidedown or similar. In detail, the U packing in an alternative design to the embodiment described first comprises a seal element which surrounds the suction tube over a certain length. In its internal surface region facing the suction tubed its length is divided into two different portions. There is first of all a portion which rests with its full internal surface against the suction tube over the entire circumference of the suction tube. Above this in the axial direction is an adjoining. internal surface region of the U packing which is of essentially saw-tooth design. The tips of the sawtooth design rest against the external surface of the suction tube over the length of the U packing while the receding regions of the sawtooth design form channels which are sealed in the downward direction in each case by the first-mentioned region. Given the pumping movement and the design of the suction tube, the lever effect which is also associated with this results in a lack of tightness in the region of the portion of full surface contact of the U packing. Additional air can then flow into the storage receptacle from outside through the other channels provided by virtue of the sawtooth design.

The invention is furthermore explained below with reference to the attached drawing, although this shows only illustrative embodiments. In the drawing:

BRIEF DESCRIPTION OF THE DRAWINGS

FIG. 3 shows an enlarged representation of the nozzle area with the pump piston in cross-section, the outlet valve being unsectioned;

FIG. 4 shows a representation in accordance with FIG. 3 of an alternative embodiment;

FIG. 7 shows an isolated representation of the U packing in cross-section;

FIG. 8 shows a partially sectioned and partially unsectioned representation of the spray pump with the U packing, in the unactuated condition;

FIG. 10 shows an enlarged representation of the collar region as depicted in FIG. 8;

FIG. 15 shows a representation in accordance with FIG. 11 and FIG. 12 with partially represented storage receptacle, unsectioned in the region of the pump chamber;

FIG. 16 shows a representation sectioned along the line XVI—XVI in FIG. 15;

DETAILED DESCRIPTION OF THE PREFERRED EMBODIMENTS

Figure 1:
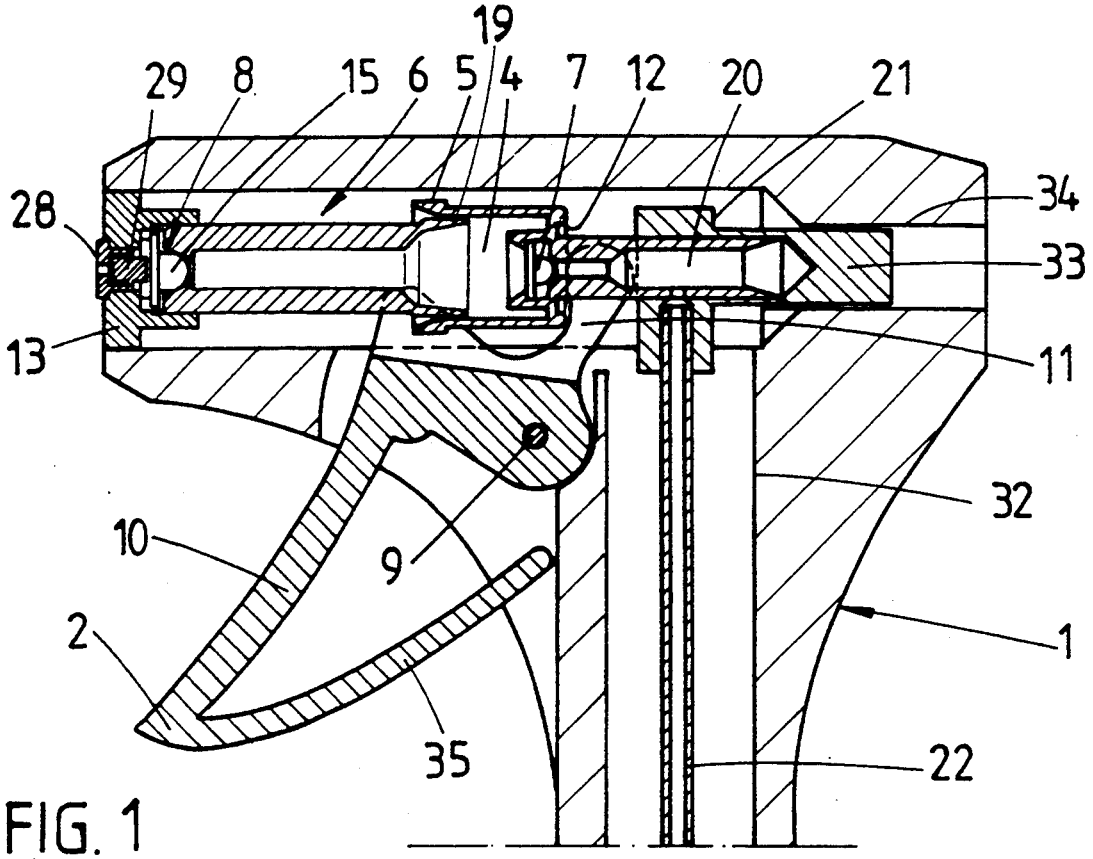
FIG. 1 shows a spray pump in cross-section in the unactuated condition.

The subject-matter of the illustration and description is a spray pump 1, which is actuated via a hand lever 2. The spray pump 1 can be mounted as a whole on a storage receptacle 3 (cf. FIGS. 8, 9) and can, in particular, also be screwed on.

The spray pump 1 has a pump chamber 4, which is formed by a pump cylinder 5 which interacts with a pump piston 6. An inlet valve 7 and an outlet valve 8 are formed in the pump chamber 4.

The actuating handle 2 is rotatably mounted via the pivot 9 and has a short lever arm 11 formed on the other side of the pivots from the handle portion 10. The short lever arm 11 acts on a rear face 12 of the pump cylinder 5. Upon actuation of the spray pump 1, the pump cylinder 5 is displaced forwards relative to the fixed pump piston 6 and an outlet nozzle 13.

During this process, the outlet valve 8 opens due to the excess pressure arising in the pump chamber 4 and pump piston 6.

The manner of interaction between the nozzle part 13 and the pump piston 6 together with the outlet valve 8 is explained in greater detail with reference to FIGS. 3 to 6.

In its forward region, the pump piston 6 forms a tapered sealing surface 14 which interacts with a hemispherically shaped sealing part 15 of the outlet valve 8. In the case of the subject-matter of FIG. 5, the outlet valve 8 is clamped directly into the pump piston 6. For this purpose, a snap-in claw 27 is formed in the forward end region of the pump piston 6.

In the illustrative embodiments of FIGS. 3 and 4, the outlet valve 8 is clamped between the nozzle part 13 and the pump piston 6. For this purpose, retention webs 16, 17 are formed both on the nozzle part 13 and on the pump piston 6. As a result, the liquid emerging from the pump piston 6 can flow round the fixing collar 18 in the opened condition of the outlet valve 8. The fixing collar 18 is also designed with a smaller diameter than the maximum diameter of the pump piston 6 and of the nozzle part 13 in this region. Centring of the outlet valve 8 is provided by the interaction of the sealing part 15 with the sealing region 14 of the pump piston 6.

An outlet nozzle 28 is furthermore arranged in the nozzle part 13, cf. for instance FIG. 3. The outlet nozzle 28 is designed with a limiting part 29 which limits an axial mobility of the outlet valve 8.

In the illustrative embodiment in accordance with FIG. 4, the limiting part 29 is formed directly on the outlet valve 8. The outlet nozzle part 13 can thereby be of integral design, as depicted. In this embodiment, it is furthermore possible for swirl channels to be formed in a manner known per se by suitable ribs 30 or the like, namely when, in the actuated condition of the outlet valve 8, the ribs 30 rest against face 31 of the nozzle part 13.

Figure 6:
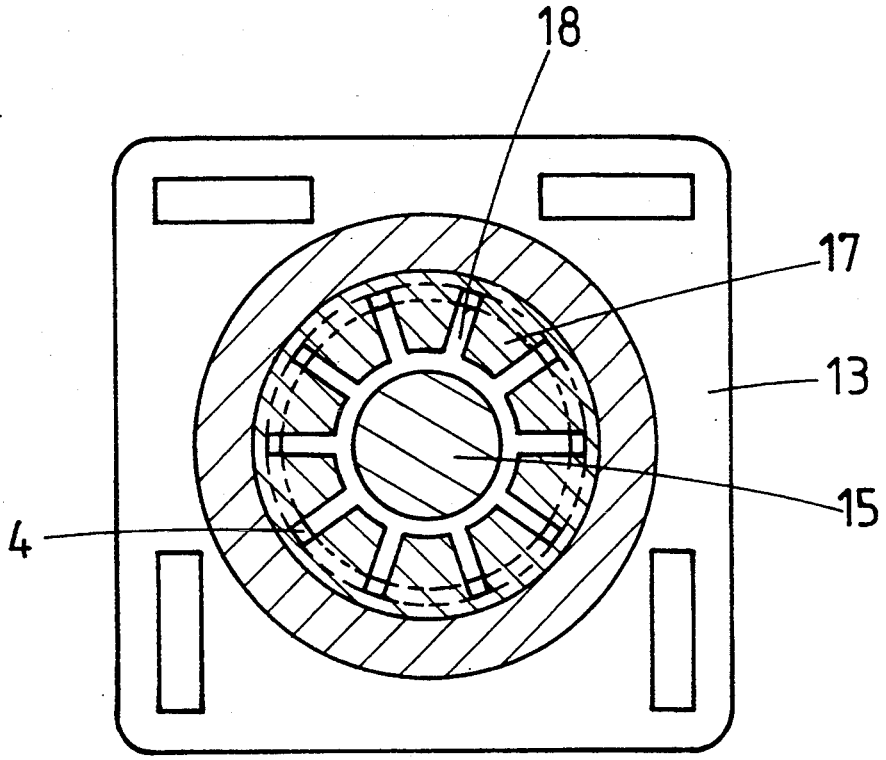
FIG. 6 shows a cross-section through the subject-matter of FIG. 4 along the line V—V

The overlap between the webs and the fixing collar 18 can be seen from the sectional representation in accordance with FIG. 6. This makes it clear that the liquid can flow round the fixing collar 18 in the open condition of the outlet valve 8.

Figure 9:
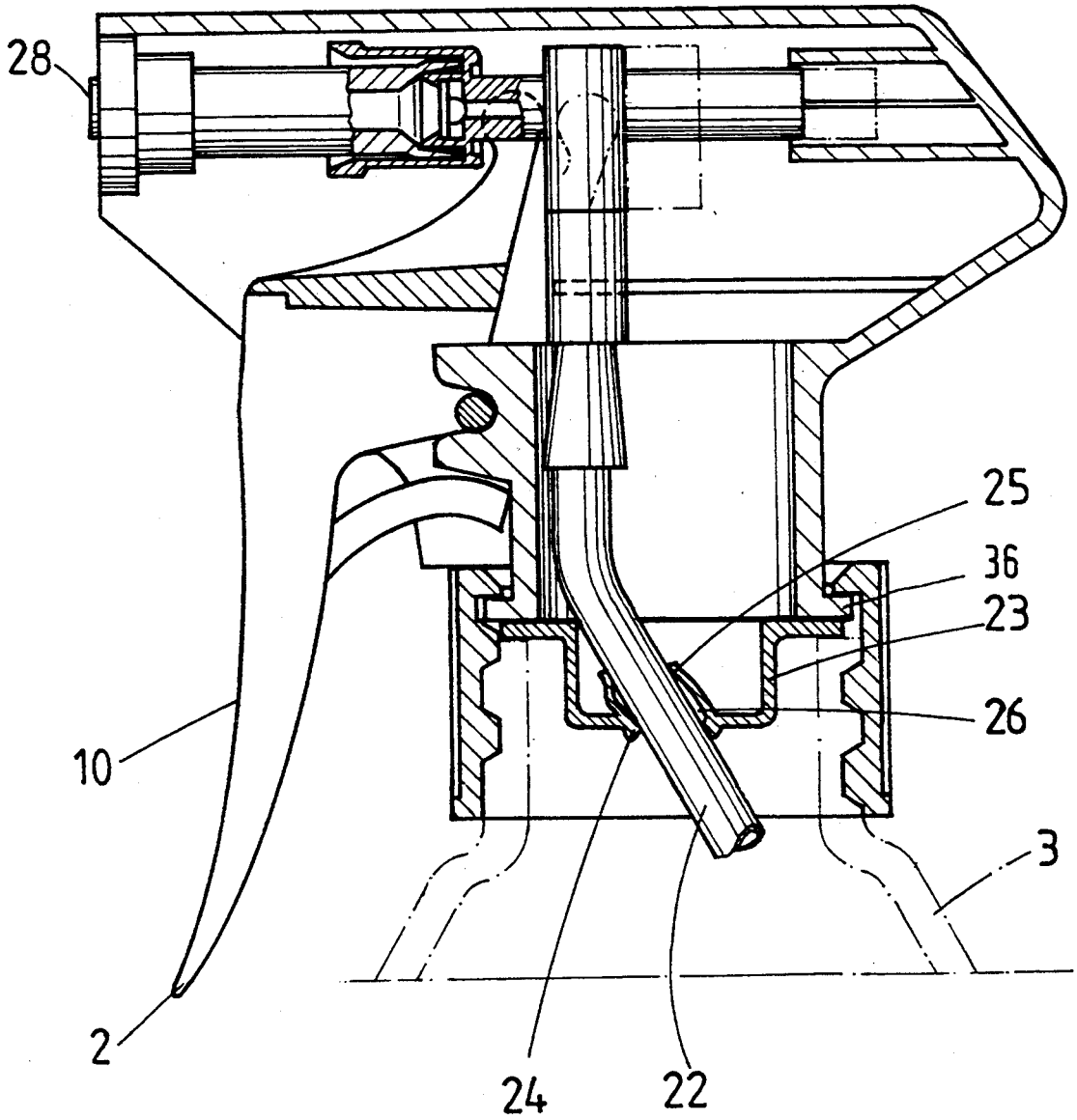
FIG. 9 shows a representation in accordance with FIG. 7, in the actuated condition.

The fundamental principle of operation of the spray pump can be seen from the representation in FIGS. 8 and 9, in which the functional parts are closed.

The pump cylinder 5 is moved counter to the fixed piston 6 via the hand lever 10.

Figure 2:
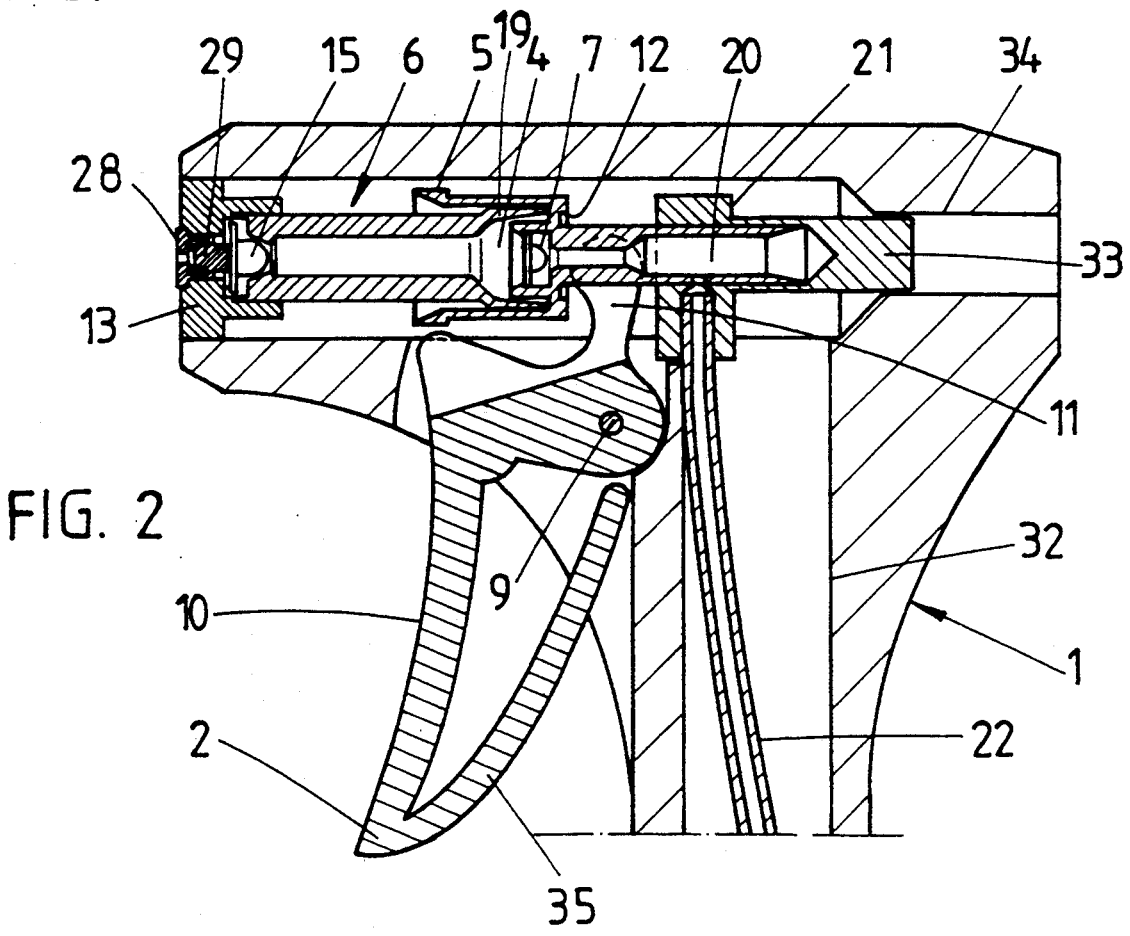
FIG. 2 shows the spray pump according to FIG. 1 in the actuated condition.
Figure 5:
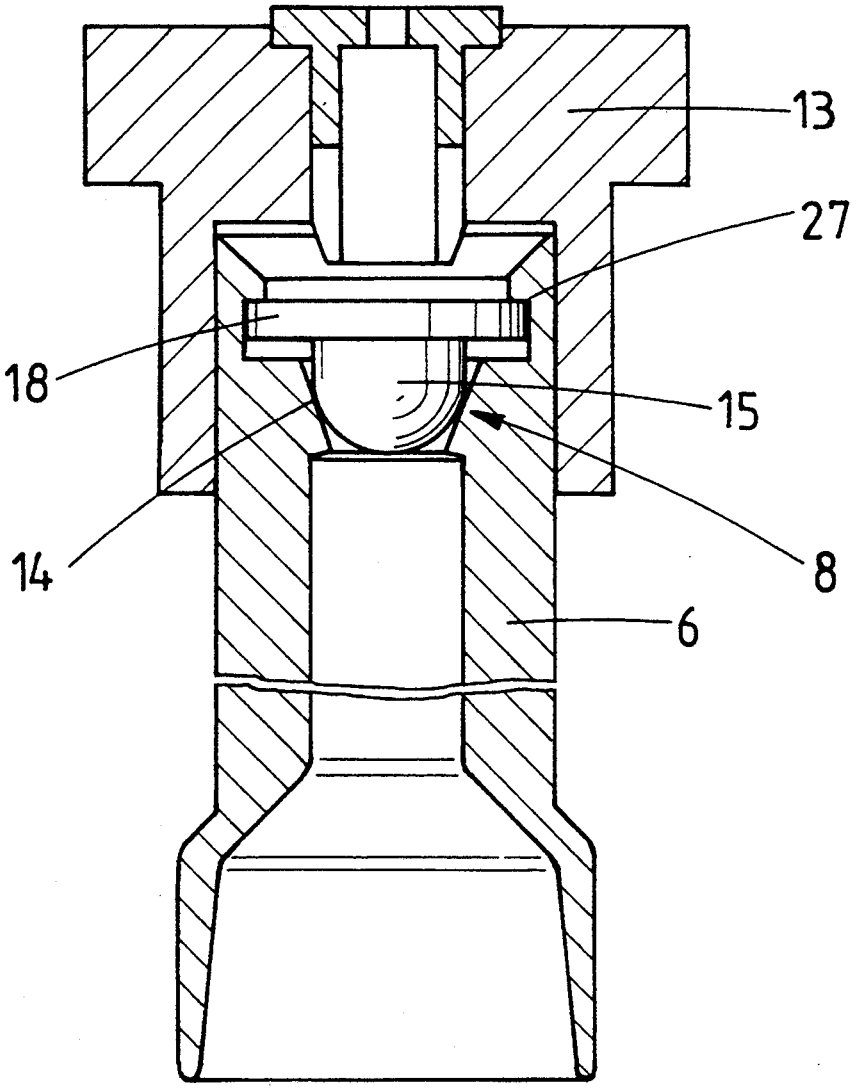
FIG. 5 shows a representation in accordance with FIGS. 3 and 4 of a further alternative embodiment.

As shown, in particular, in FIGS. 1 and 2 also, the inlet valve 7 can be of identical construction to the outlet valve 8.

Upon hand-lever actuation of the spray pump, the liquid in the pump chamber 4 is put under pressure. This pressure reinforces the closing effect of the inlet valve 7 but has an opening effect on the outlet valve 8. Flowing round the outlet valve 8 the liquid can then emerge from the outlet nozzle 13.

The axial series arrangement of the outlet nozzle, the pump piston, the pump cylinder and the antechamber and the axially movable mounting of the constructional unit comprising the pump cylinder, the antechamber and the bearing portion 19 provides a spray pump 1 which is not only simple to assemble but is also easy to handle. Connected upstream of the pump chamber 4 is an antechamber 20. This is of integral design with the pump piston 6. Opening into the antechamber 20 is the suction tube 22. For this purpose, a separate retention element 21 is provided, into which the antechamber 20 is inserted. The retention element 21 also forms a cylindrical bearing, guiding extension 33, which rests with axial displaceability in a corresponding bearing slot 34 in the pump head.

Upon pump actuation, the retention element 21 firmly connected to the antechamber 20 is likewise moved axially due to the arrangement described and, in the process, deflects the immersion tube 22 from its axis of rest. Since the immersion tube 22 moves in a vertical cylindrical hole 32 of the pump head, an actuation stop is also provided by contact of the immersion tube with a wall of the hole (cf. FIG. 2).

To seal off the pump head relative to a storage receptacle 3, the immersion tube 22 is surrounded by a U packing 23.

As can be seen from FIGS. 7, 8 and 9, the U packing 23 is overall of essentially cup-shaped design. It is arranged with the cup orifice facing upwards, i.e. towards the antechamber 20.

The sectional representation in accordance with FIG. 7 makes it clear that the U packing 23 has two axially spaced regions 24 and 25 which rest against the suction tube 22, with a region 26 spaced from the suction tube 22 lying between them.

In one region 24, the U packing rests against the immersion tube 22 over a very short axial length of a few tenths of a millimetre while, in the other region 25, it rests against the tube over a longer axial length of, for instance, 2 to 3 millimetres. The region of greater axial contact 25 is arranged in the cup orifice and hence closer to the antechamber 20 in the installed condition.

Upon pump actuation, as depicted in FIG. 9, a lack of tightness arises in the actuated condition due to the regions described and their arrangement and the tilting which occur is in the process due to the deflection of the immersion tube 22, the said lack of tightness allowing additional air to flow inwards into the storage receptacle 3 from the outside. In the unactuated condition, as depicted in FIG. 8, on the other hand, tightness is guaranteed, even allowing the spray pump to be held upsidedown without liquid escaping.

Figure 11:
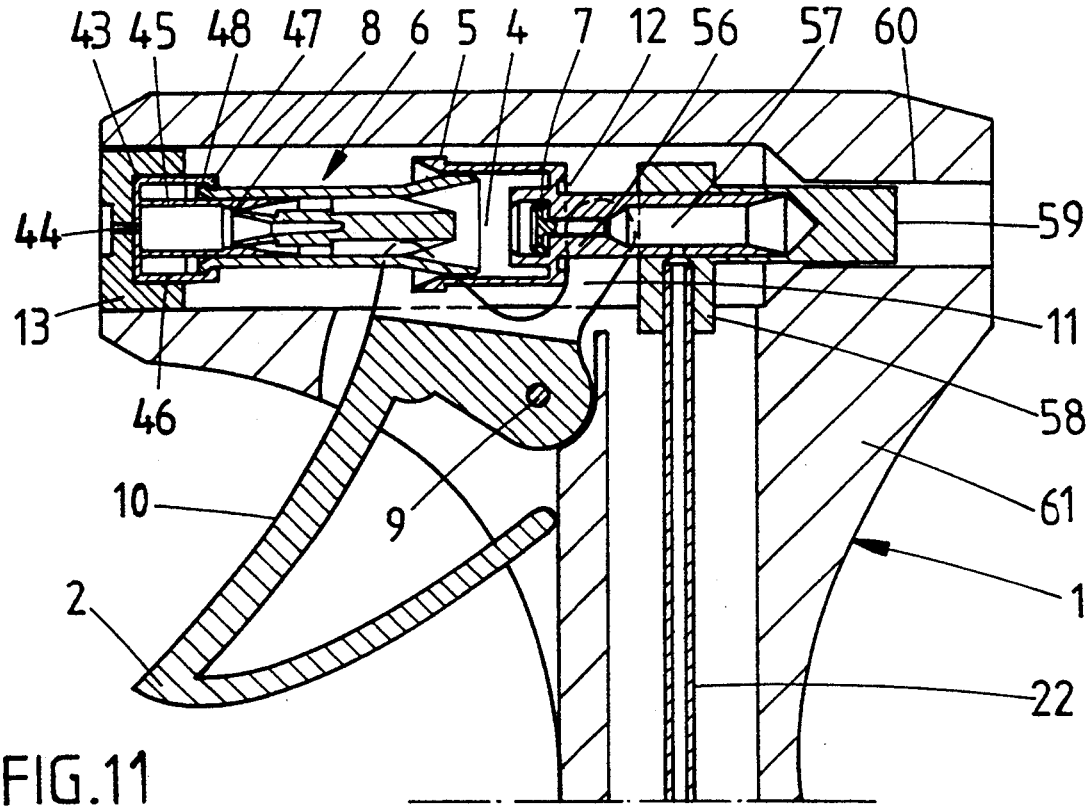
FIG. 11 shows a spray pump in cross-section in an alternative embodiment and in the unactuated condition.

The partial representation in accordance with FIG. 10 shows the holding of the U packing 23 between the pump head and the storage receptacle 3. A cup collar 35 is clamped between an upper rim of the storage receptacle 3 and a lower rim 36 of the pump head. The rim 36 is overlapped by a screw cap 37.

with reference, in particular to FIGS. 11 and following, these likewise show a spray pump 1 which can be actuated via a hand lever 2. The spray pump 1 can likewise be mounted overall on the storage receptacle 3 (see also FIG. 15) and, in particular, can be screwed onto it.

The spray pump 1 has a pump chamber 4 formed by a pump cylinder 5 which interacts with a pump piston 6 and, to this extent, remains of identical configuration. An inlet valve 7 and an inlet valve 8 are formed in the pump chamber 4 (cf. in this connection also FIGS. 13 and 14).

The actuating handle 2 (hand lever) is rotatably mounted via the pivot 9 and has a short lever arm 11 formed on the other side of the pivot 9 from the handle portion 10. The short lever arm 11 acts on a rear face 12 of the pump cylinder 5. Upon actuation of the spray pump 1, the pump cylinder 5 is displaced forwards towards the fixed pump piston 6 and an outlet nozzle 13.

During this process, the outlet valve 8 opens due to a slight displacement of the pump piston 6, as described in greater detail below with reference to FIGS. 13 and 14.

Figure 13:
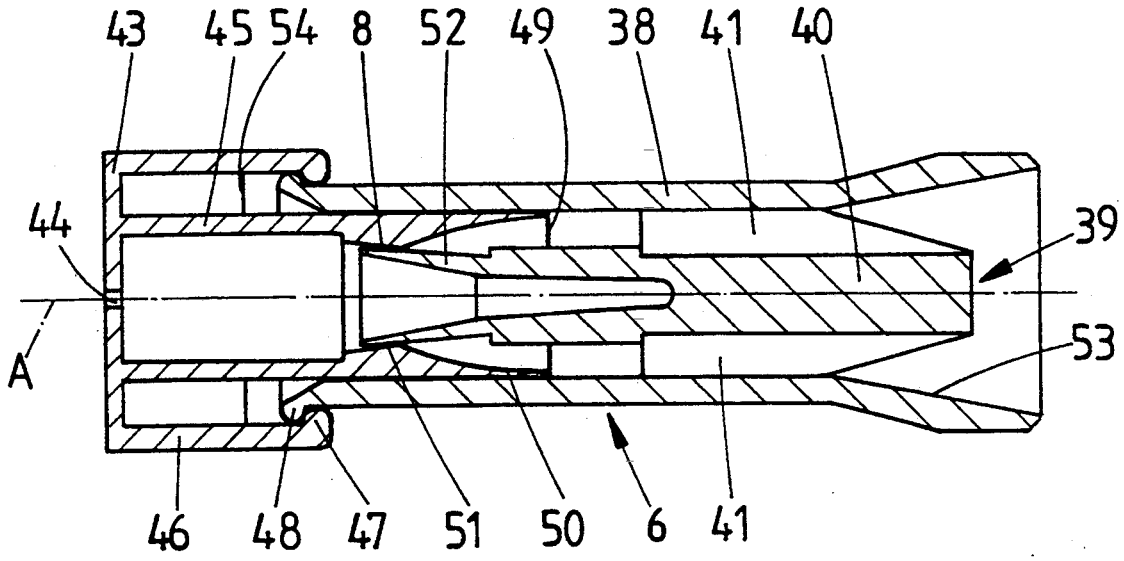
FIG. 13 shows the pump piston in interaction with the spray nozzle in the embodiment according to FIG. 11, in the unactuated condition and on an enlarged scale.
Figure 14:
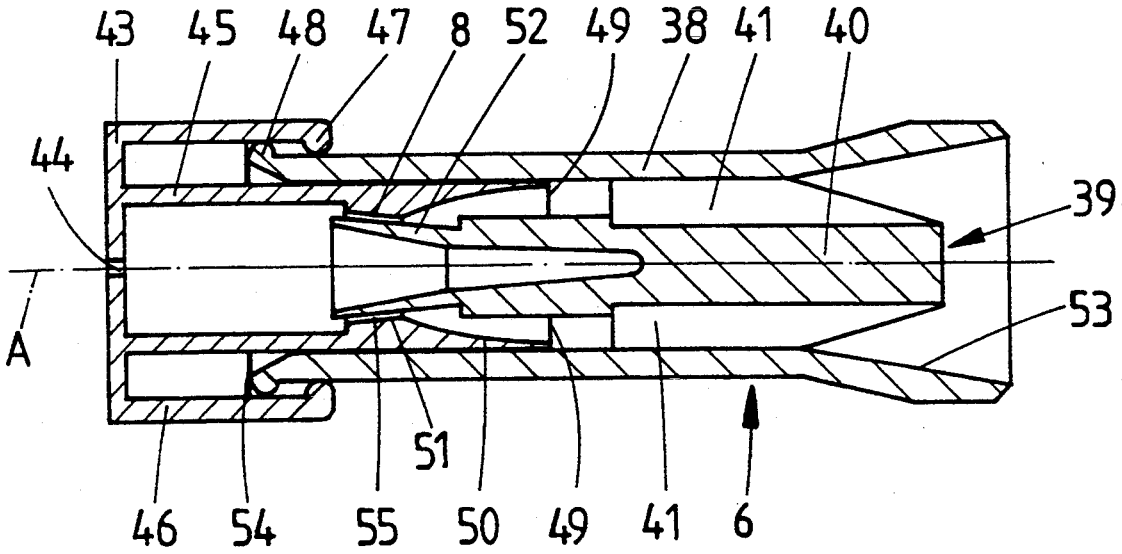
FIG. 14 shows the spray nozzle and the pump piston in accordance with FIG. 11 in the actuated condition.

In FIG. 13, the pump piston 6 is depicted in the closed position of the outlet valve 8. The pump piston 6 has an outer piston tube 38 an in inner insert 39, which is preferably of integral design with the piston tube 38. This insert 39 has a flow divider 40 which is of a design similar to a flow divider, is arranged approximately coaxially to a centre line A of a combination insert 39/pump piston 6 and opens like a tube towards the outlet nozzle 13. In its front portion, the flow divider 40 also widens conically outwards, the flow divider 40 is held in the piston tube 38 and spaced from an inner wall 42 of the latter by supporting webs 41.

Arranged in the outlet nozzle 13 is a nozzle insert 43. Facing the outlet nozzle 13, the nozzle insert 43 first of all has a passage opening 44 for dispensing the liquid. Adjoining this on the inside, facing the pump piston 6 in the installed condition, is a tubular part 45 which, in the installed condition, is in partial overlap with the flow divider 40, in particular the forward tubular formation of the latter (cf. FIGS. 13, 14). Formed coaxially to part 45 is a further tubular part 46 which, at its end facing the pump piston 6, forms a retention bead 47 which projects inwards.

A corresponding, outward-projecting retention bead 48 is formed by the pump piston 6.

Starting from its remotest end 49, the inner, tubular part 45 has a funnel 50 which tapers conically or with a slight curvature in the direction of flow and then merges into the portion 51 already mentioned which widens conically outwards. The conical inner surface of portion 51 interacts as a closure with the conical outer surface of the associated tubular portion 52 of the flow divider 39. Due to the flexibility of portion 52, it can, for the purpose of assembly, be pushed into portion 51 of the nozzle insert 43 while simultaneously overcoming the snap-in beads 47 and 48.

In the illustrative embodiment, the pump piston 6 likewise opens conically at its end facing away from the nozzle part 13 (cf. reference numeral 53). When the pump is actuated, the projected surface of this portion results in a pressure on the pump piston 6 which tends to push the latter forwards. As can be gathered from a comparison between FIGS. 13 and 14, the pump piston 6 can thereby be displaced forwards by a small amount, as far as limit 54 in the nozzle insert 43. This displacement of the pump piston 6 upon pressure loading results in a flow path 55 between the outer surface of portion 52 of the flow divider 40 and the inner surface of portion 51 of the nozzle insert 43, allowing the liquid through, with the result that this then finally emerges from the nozzle part 13.

On completion of a spraying operation, when the loading of the hand lever 2 is removed, the latter returns to its initial function (cf. FIGS. 1, 11). During this process, portion 11 of the hand lever takes the pump cylinder 5 back with it into its starting position. The pumps piston 6 is initially taken along for a short distance until it is in the position in accordance with FIG. 13 again. The outlet valve 8 is thereby closed, with the result that a vacuum arises in the pump chamber 4. This vacuum opens the inlet valve 7 and additional liquid is sucked out of the storage receptacle 3 via the suction tube 22.

Figure 12:
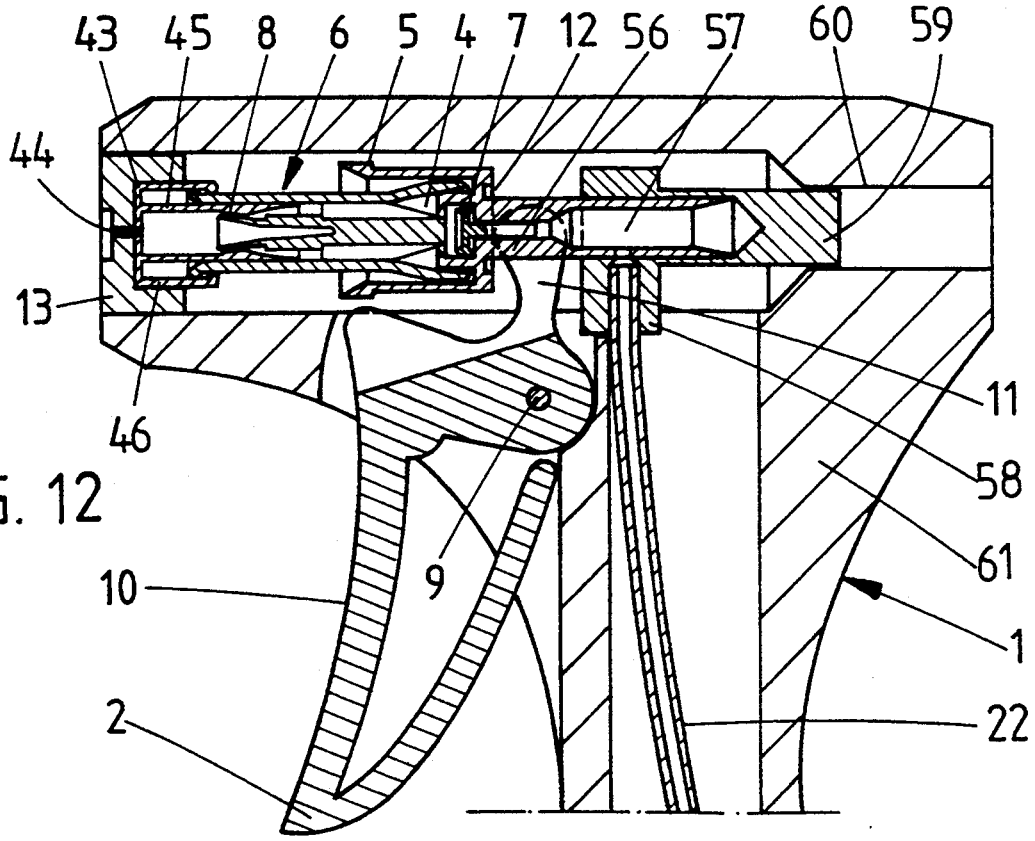
FIG. 12 shows the spray pump in accordance with FIG. 11 in the actuated condition.

Referring to FIGS. 11 and 12, it can be seen that, adjoining the pump cylinder 5 in the opposite direction to the flow, there is a connecting line 56 which connects the pump cylinder 5 to an antechamber 57. Opening approximately at right angles into the antechamber 57 is the suction tube 22, which is connected via a retention element 58 to the antechamber 57. The retention element 58, which is fixedly connected to the corresponding tubular part of the antechamber 57, simultaneously forms a counterstop for the lever portion 11 when the handle 2 executes its return motion, Formed in a further axial extension of the antechamber is a guiding shoulder (extension) 59 which runs in a hole 60 (horizontal in the drawing) in the pump head.

From a comparison of FIGS. 11 and 12, it can furthermore be seen that, when the pump is actuated, the suction tube 22 is deflected sideways in a neck region 61 of the pump head (in relation to the cross-sectional representation in the drawing). This deflection is greatest in the region in which the suction tube 22 is gripped in the retention part 58. However, the deflection also extends downwards.

This is of importance for a ventilation achieved in the subject-matter depicted.

When the pump is actuated, additional liquid is sucked out of the Storage receptacle 3 during the return motion of the handle 2, as already described. Fundamentally, therefore, a vacuum arises in the storage receptacle 3. In order to compensate this, a possibility for allowing air to flow in Via a U packing is provided. This U packing 62, which is clamped between the pump head and the storage receptacle 3, has a sealing portion 63 in contact over a certain axial extent of the suction tube 22. As can be seen, in particular, also when seen in conjunction with FIG. 16, this sealing portion 63 is of saw-toothed design over a relatively large part of its length, facing the suction tube 22. The respective tips 64, 65 rest against the suction tube 22. Longitudinally extending channels 66 are formed between them.

Adjoining the longitudinally extending channels 66 towards the bottom—in the drawing—is a seal region 67. In this seal region 67, the full surface of the seal material rests against the outer wall of the suction tube 22. The length ratio of the sealing portion 63 to the seal region 67 is preferably about 3–4 to 1.

During the deflection of the suction tube 22, which occurs regularly upon pump actuation (cf, for example, FIG. 12), the displacement of the suction tube also results in tilting in the region of the U packing 62, leading to a lack of tightness in the region of seal region 67. Since there are adjoining air channels 66 above this, additional air can thus flow into the interior of the storage receptacle 3 in the deflected condition in order to compensate the vacuum. In the unactuated condition, however, as depicted, for example, in FIGS. 15 and 11, complete sealing is provided by region 67. Even if the spray pump is held upsidedown, no liquid can escape. The U packing 62 is composed of a customary soft-elastic seal material.

With the exception of the differences explained below, the embodiment in accordance with FIGS. 17 to 21 is in principle designed in a manner corresponding to the embodiment described first of all. Insofar as no differences are explained in detail below, the above description also applies to this illustrative embodiment.

Figure 17:
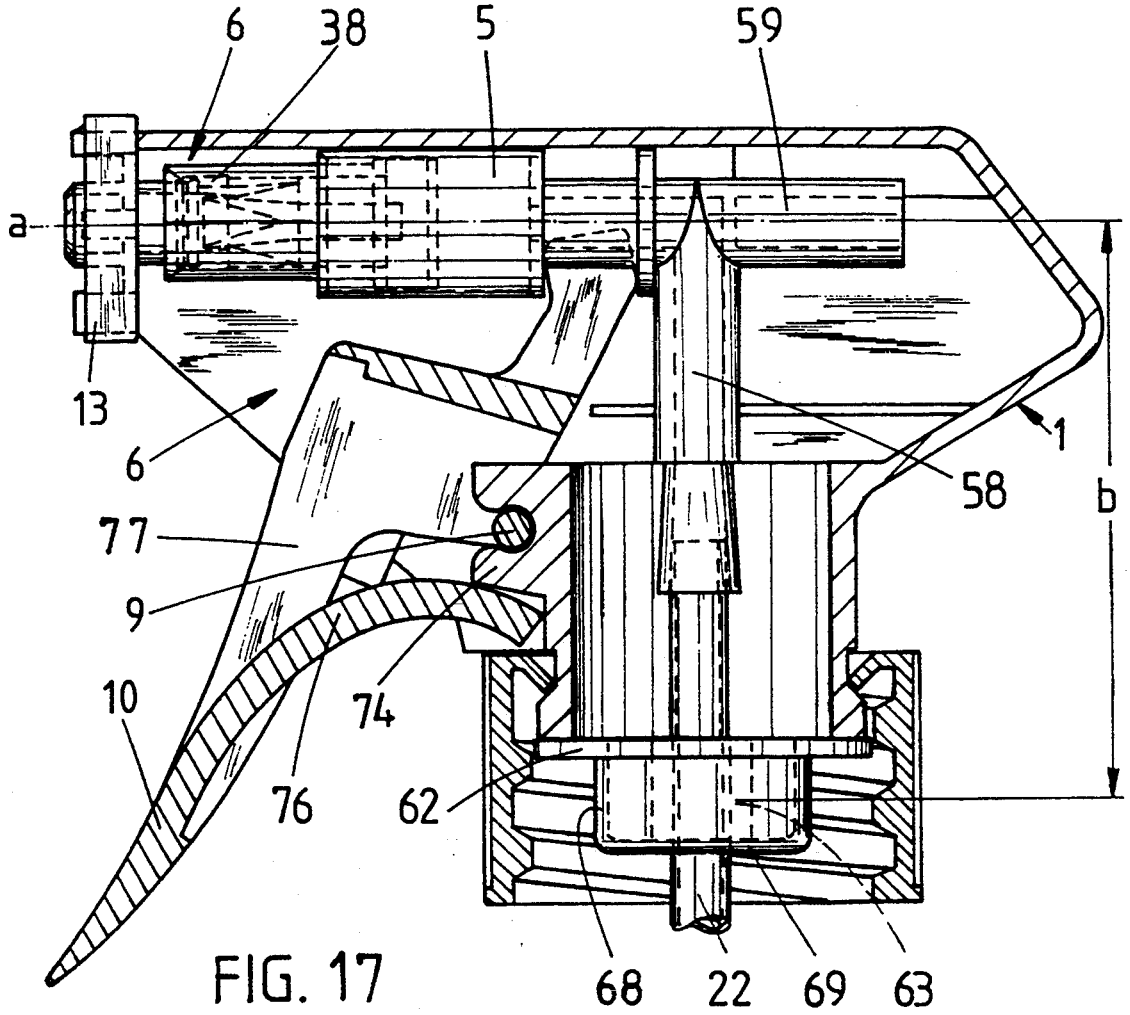
FIG. 17 shows a representation in accordance with FIG. 11 in an alternative embodiment.
Figure 18:
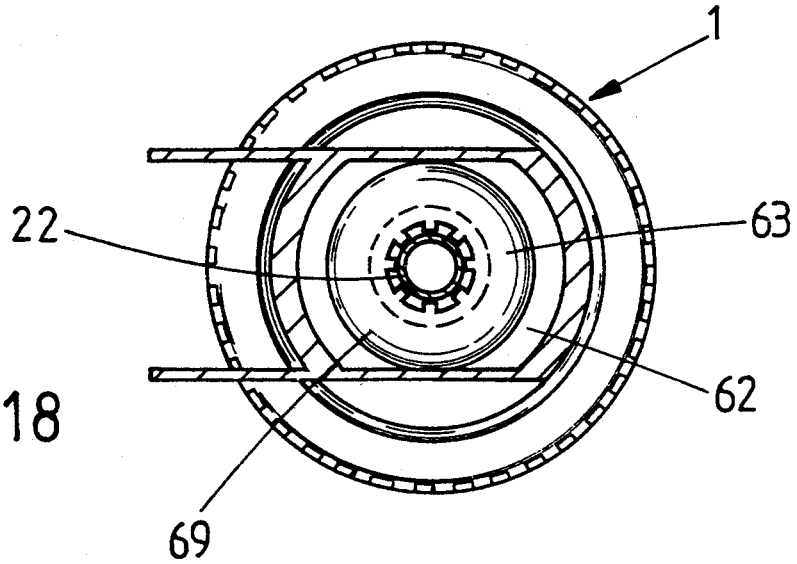
FIG. 18 shows a bottom view of the subject-matter of FIG. 17 without the handling portion and the dispenser head.

From the illustrations in accordance with FIGS. 17 and 9, it can first of all be seen that a distance from a centre line a of the pump chamber to the sealing region 39 is chosen to be comparatively small. The distance b corresponds approximately to 8–12 times, preferably 10 times, the inside diameter of the ascending tube 22 or liquid line.

Figure 19:
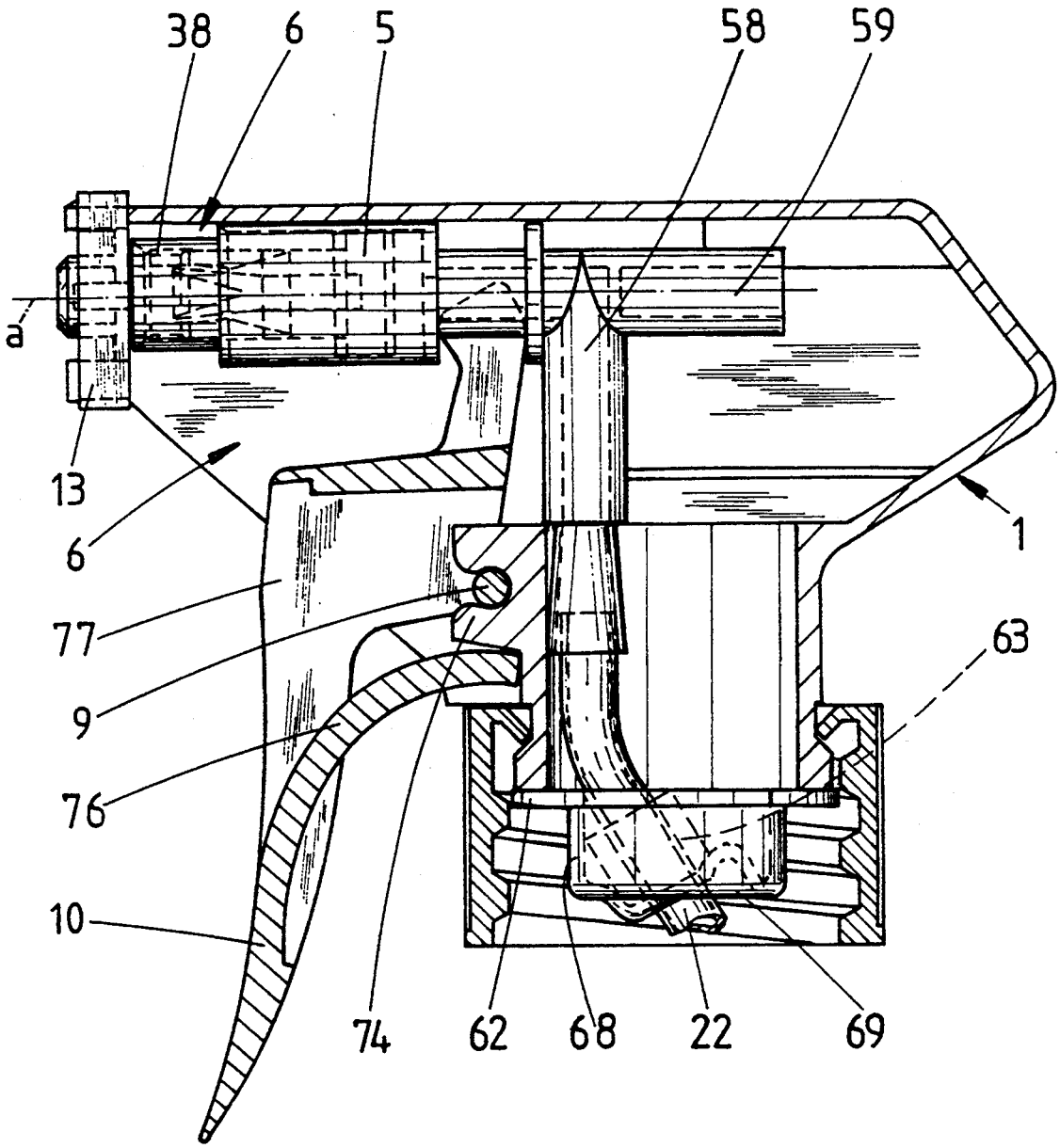
FIG. 19 shows a representation in accordance with FIG. 17 in the actuated condition.
Figure 20:
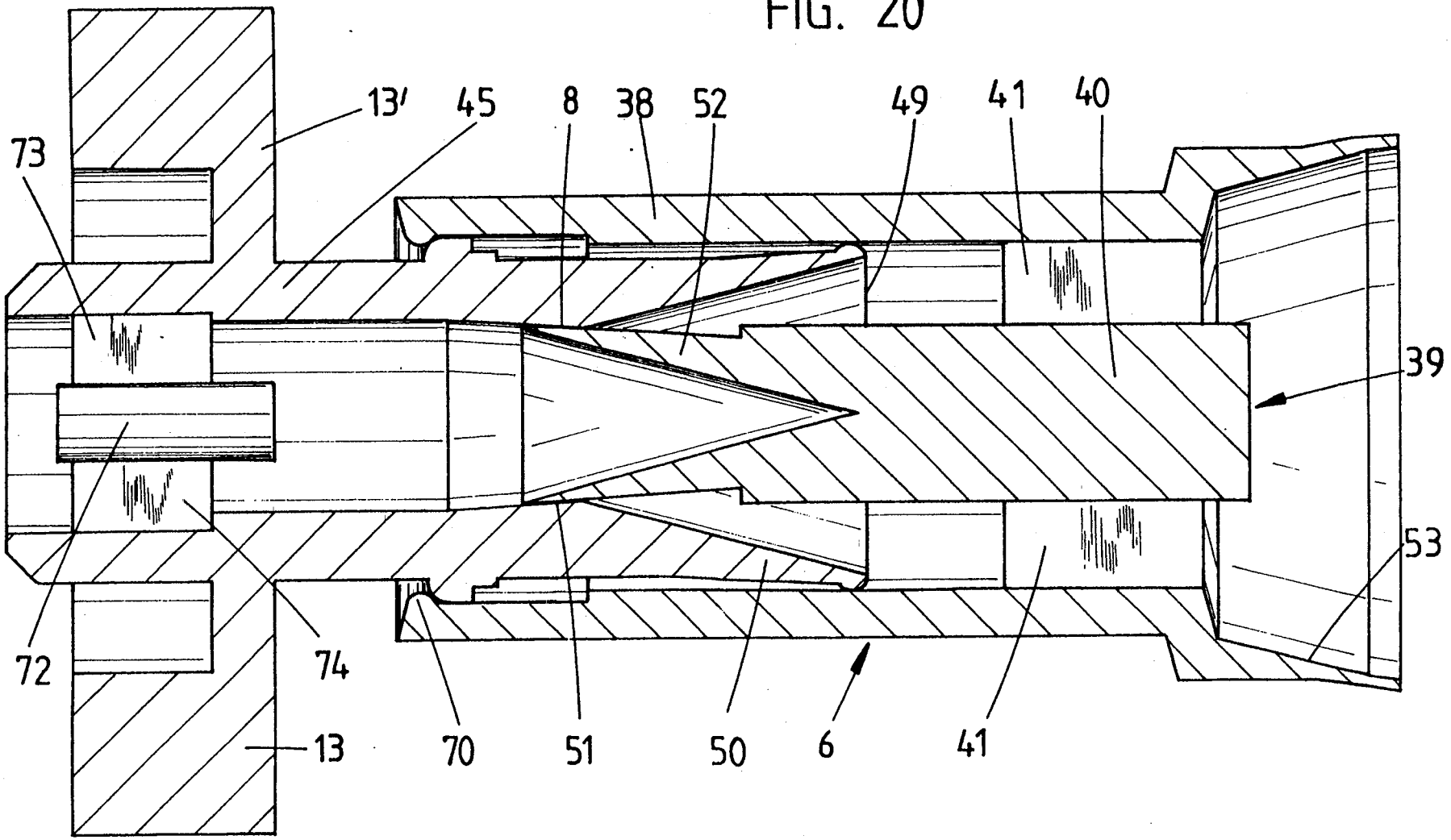
FIG. 20 shows an enlarged representation of the valve region of the embodiment in accordance with FIG. 17, in the unactuated condition.
Figure 21:
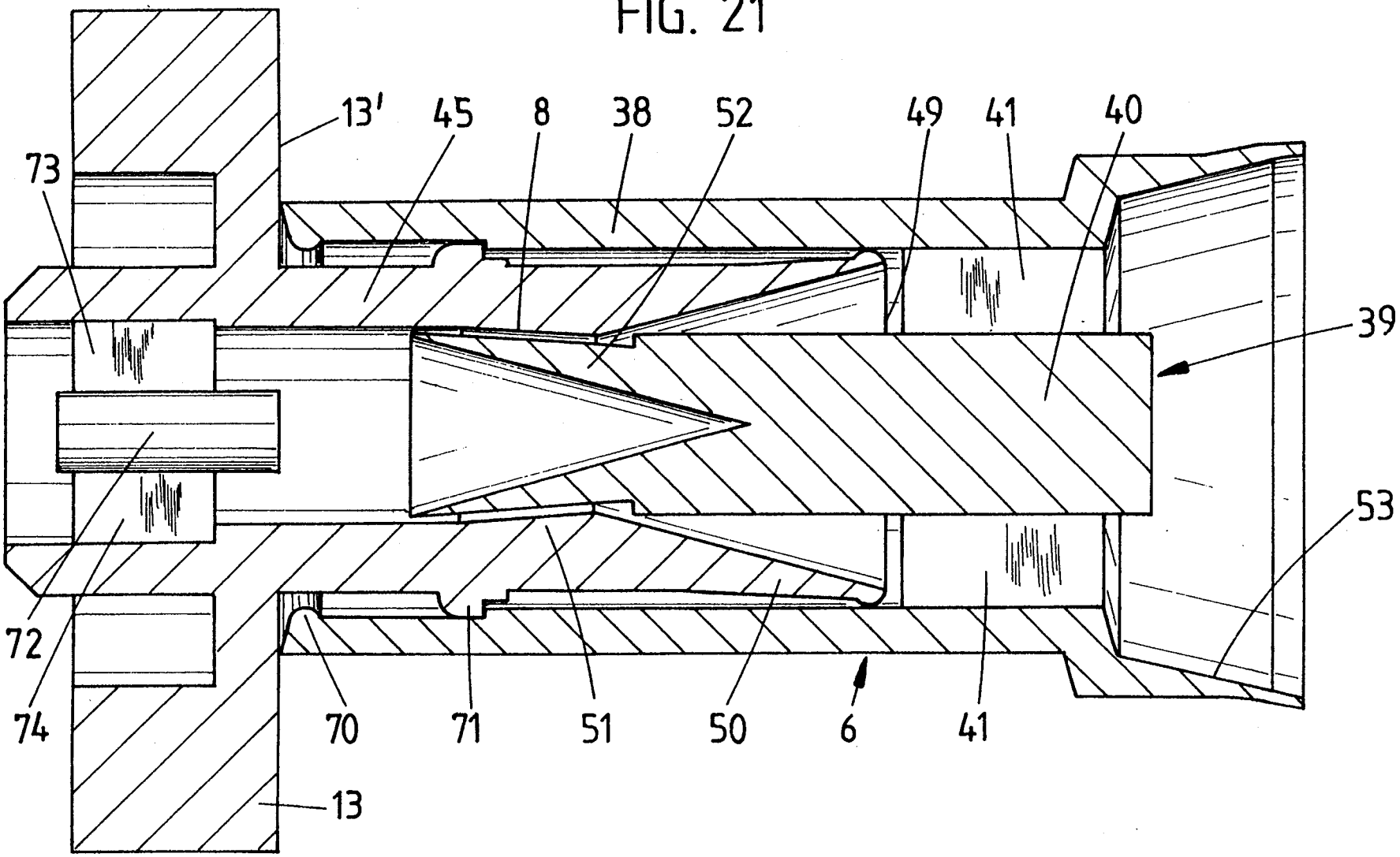
FIG. 21 shows a representation in accordance with FIG. 20 in the actuated condition.

As can be gathered, in particular, also from FIG. 19, the sealing portion 63 is arranged in a cup-shaped protuberance 68 of the sealing portion 63. This permits a deflection in the actuated condition as depicted in FIG. 19. This has the advantageous effect of assisting the valve mechanism.

In detail, the protuberance 68 is moulded upwards (in the installed condition) from the U packing 62. The actual seal region extends downwards from the end region 69 of the protuberance, ending in terms of length with the U packing 62. The vertical extent of the protuberance corresponds to approximately twice the diameter of the ascending tube.

As can furthermore be gathered, in particular, from FIGS. 17 and 19, the elements (tips 64, 65) in contact extend upwards in the sealing portion 63, continuing beyond the end region 69. They open outwards, thus providing overall an insertion aid when inserting the immersion tube The seal elements are furthermore not pointed in cross-section but rounded at the inside, at the contact surface, resulting in a certain area of contact and not just a contact tip.

As regards the valve design (FIGS. 20 and 21), there is a certain simplification vis-a-vis the illustrative embodiment described first of all above. As was in fact also depicted in FIGS. 13 and 14, the outlet nozzle 13 continues directly into the portion 51 which forms the internal conical surface. However, the snap-in connection between the piston tube 38 and the outlet nozzle 13 is implemented on the outside of the tubular portion which extends within the piston tube 38. For this purpose, the end of the piston tube 38 has an inward-pointing encircling rim 70 of dog-shaped cross-section, the mobility of which on the outside of portion 51 is limited, on the one hand, by a rear wall 13' of the outlet nozzle part 13 and, on the other hand, by an identical but externally arranged projection 71.

Arranged centrally in the outlet nozzle 13 itself is a flow divider 72 which correspondingly deflects the jet. This flow divider 72 is held in the outlet nozzle 13 via the wall parts 73, 74.

The pump head 1 is overall of integral design. The outlet nozzle part 13 together with the pump piston 6 is clipped to the latter. The handle portion 10 is likewise clipped to the pump head 1. For this purpose, the handle portion 10 has an integrally formed pivot 9 into which a fork 75 of the pump head 1 can snap.

The manual actuating portion 10 is designed with an integrated return spring 76. This return spring 76 is arranged between two side regions 77 of the manual actuating portion 10. The return spring 76 has an abutment underneath the snap-in fork 75.

Figure 22:
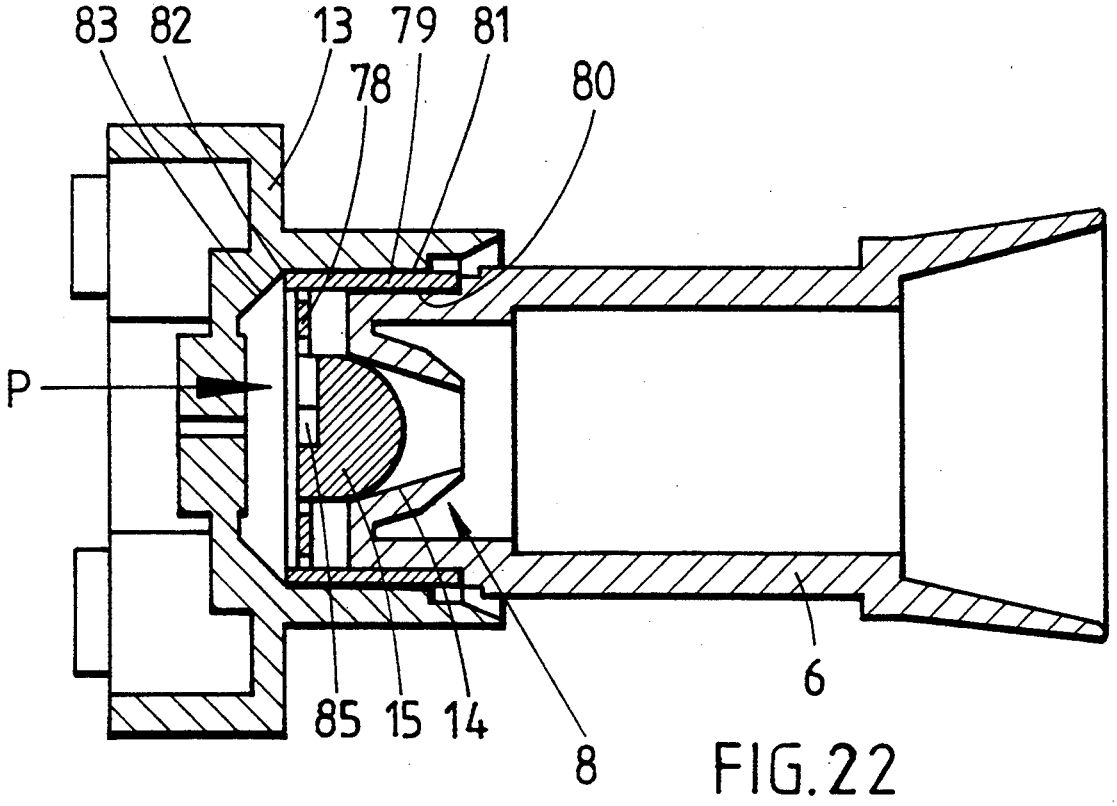
FIG. 22 shows a cross-sectional representation, in accordance with FIGS. 3 and 4, of a further alternative embodiment of the outlet valve.
Figure 23:
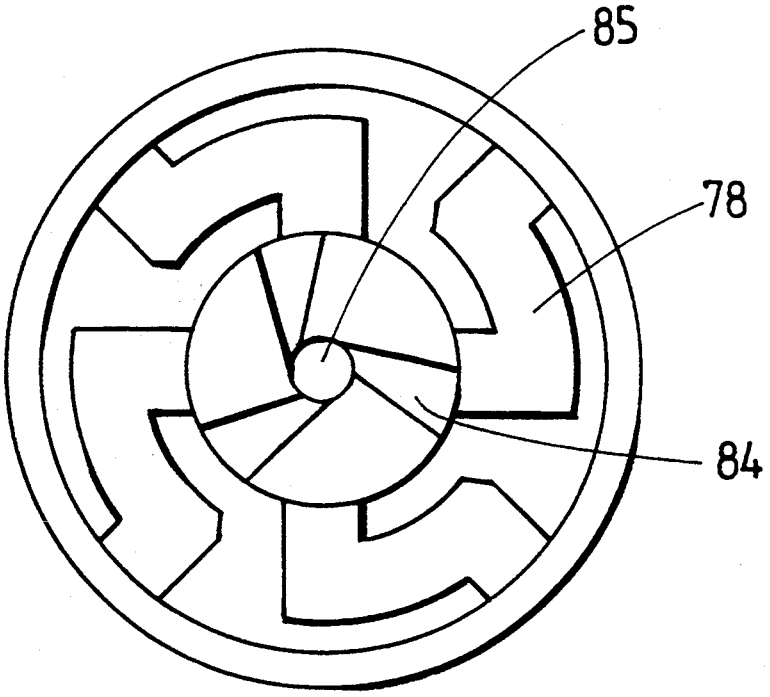
FIG. 23 shows a plan view of the outlet valve in accordance with FIG. 22, as seen in the direction of arrow P.

In the embodiment in accordance with FIG. 22, the outlet valve 8 is of identical construction as regards the sealing part 15 as in the embodiments in accordance with FIGS. 3 and 4. However, the sealing part 15 in the embodiment according to FIGS. 22 and 23 is attached to a sleeve 79 via spring webs 78. The sleeve 79 is clamped between the nozzle part 13 and the frontal region of the pump piston 6, the sleeve 79 extending on an outer circumferential wall portion 80 of the pump piston 6 and an inner circumferential wall portion 81 of the nozzle part 13 over a depth corresponding to the conical sealing surface 14. The sleeve 79 is fixed axially with respect to the outlet nozzle by the transition 82 to a conical surface 83 of the nozzle part 13. The conical surface 83 simultaneously provides the necessary motional clearance for the opening movement of the sealing part 15.

Also of significance, and this is particularly evident from FIG. 23, is the design of the sealing part 15 at the front. As the liquid flows round the sealing part 15, the necessary swirling effect is simultaneously achieved by virtue of the notches 84 extending essentially radially. In cross-section, the notches 84 are of U-shaped configuration. A central, circular recess 85 is further recessed compared to the notches 84, resulting in a further step from a base surface of a notch 84 to a base surface of the recess 85.

I claim:

1. Hand lever-actuated spray pump comprising a pump chamber which has an inlet valve and an outlet valve, the chamber including a pump cylinder and a pump piston which interacts with the pump cylinder;

a lever-like actuating handle which is connected to the pump cylinder;

a suction tube operatively connecting with the pump chamber;

wherein the pump cylinder is movable relative to the pump piston in order to carry out a pumping operation;

the pump further comprises a return spring providing a return relative motion between the pump piston and the pump cylinder;

a pump head enclosing the pump chamber, an outlet nozzle fixed in the pump head, a guiding extension being connected to the pump cylinder and being displaceable in an axial hole of the pump head;

wherein the pump piston and the pump cylinder are arranged in axial extension of the outlet nozzle and are supported in the pump head via the guiding extension which is arranged also in axial extension of the outlet nozzle and which runs in the axial hole in the pump head;

the pump piston is held captive in the fixed outlet nozzle; and the suction tube opens approximately at right angles to the axial extension of the pump cylinder and the spring acts directly on the actuating handle.

2. Spray pump according to claim 1 wherein the outlet valve is arranged between the outlet nozzle and the pump piston.

3. Spray pump according to claim 2, wherein the outlet valve is clamped between the outlet nozzle and the pump piston.

4. Spray pump according to claim 1, wherein the pump piston has a widening outlet region serving as a sealing region, and a sealing part of the outlet valve is seated in sealing fashion under prestress in the widening outlet region.

5. Spray pump according to claim 1, wherein the outlet valve has a fixing collar and a sealing part, and the sealing part is a spherical cap.

6. Spray pump according to claim 1, wherein an opening limitation is provided for the outlet valve.

7. Spray pump according to claim 6, wherein the sealing part is integrally formed on the outlet valve for the opening limitation.

8. Spray pump according to claim 7, further comprising ribs to urge liquid to form a swirl upon contact with a face of the outlet nozzle in an open condition of the outlet valve, wherein the ribs are formed on one end face of the sealing part formed integrally with the outlet valve.

9. Spray pump according to claim 4, wherein the pump piston is held captive in a portion of the outlet nozzle.

10. Spray pump according to claim 1, wherein the pump piston is movable towards the outlet nozzle in order to open the outlet valve.

11. Spray pump according to claim 1, wherein the pump piston and/or the pump cylinder are mounted with axial mobility in the pump head.

12. Spray pump according to claim 1, wherein the suction tube is firmly connected to the pump cylinder.

13. Spray pump according to claim 1, wherein the return spring is formed integrally on a portion of the handle.

14. Spray pump, having a pump head and adapted to be mounted on a storage receptacle, and comprising a piston and a cylinder movable relative to each other within the head to express fluid, a suction tube operatively connected to the cylinder for drawing fluid from the receptacle to the cylinder and a U packing sealingly encircling the suction tube, the U packing being connectable to the pump head, wherein, upon actuation of the spray pump to draw fluid from the receptacle, the suction tube undergoes a tilting in the U packing by the relative movement between the piston and the cylinder opening an air path between the U packing and the suction tube to the storage receptacle by the tilting.

15. Spray pump according to claim 14, wherein said U packing comprises a first cylindrical portion encircling said suction tube and a second cylindrical portion encircling said suction tube, said first and said second cylindrical portions of said U packing being contiguous to each other, said first cylindrical portion having an axial length which is greater than an axial length of said second cylindrical portion, and an interface between said first cylindrical portion of said packing defining air passages extending in axial direction of said first cylindrical portion of said packing, said air passages being terminated by said second cylindrical portion of said U packing.

16. Spray pump, having a pump head and adapted to be mounted on a storage receptacle, and comprising a piston and a cylinder movable relative to each other within the head to express fluid, a suction tube for drawing fluid from the receptacle and a U packing encircling the suction tube, the U packing being disposed operatively between the pump head and the storage receptacle, wherein, upon actuation of the spray pump to draw fluid from the receptacle, the suction tube undergoes a tilting in the U packing by the relative movement between the piston and the cylinder, and an air path to the storage receptacle is opened by the tilting, wherein the U packing has a sealing portion with air channels, and a seal region which rests directly against the suction tube.

17. Spray pump according to claim 16, wherein the U packing rests against the immersion tube over a very short axial length in one region and over a longer axial length in a second region.

18. Spray pump according to claim 17, wherein the axial length of contact in said one region is a few tenths of a millimetre and, in said second region, is 2 to 3 millimetres.

19. Spray pump according to claim 17, wherein said one region is spaced from said second region by approximately 1 cm.

20. Spray pump according to claim 17, wherein said piston and said cylinder constitute a pump chamber, and said second region of longer axial length is arranged closer to the pump chamber.

21. Spray pump, having a pump head and adapted to be mounted on a storage receptacle, and comprising a piston and a cylinder movable relative to each other within the head to express fluid, a suction tube for drawing fluid from the receptacle and a U packing encircling the suction tube, the U packing being disposed operatively between the pump head and the storage receptacle, wherein, upon actuation of the spray pump to draw fluid from the receptacle, the suction tube undergoes a tilting in the U packing by the relative movement between the piston and the cylinder, and an air path to the storage receptacle is opened by the tilting, wherein the U packing rests against two axially spaced regions on the suction tube with the interposition of a region spaced from the suction tube.

22. Spray pump, having a pump head and adapted to be mounted on a storage receptacle, and comprising a piston and a cylinder movable relative to each other within the head to express fluid, a suction tube for drawing fluid from the receptacle and a U packing encircling the suction tube, the U packing being disposed operatively between the pump head and the storage receptacle, wherein, upon actuation of the spray pump to draw fluid from the receptacle, the suction tube undergoes a tilting in the U packing by the relative movement between the piston and the cylinder, and an air path to the storage receptacle is opened by the tilting, wherein said packing included a sealing portion having a sawtooth inner profile including profile tips resting against the suction tube.

23. Spray pump, having a pump head and adapted to be mounted on a storage receptacle, and comprising a piston and a cylinder movable relative to each other within the head to express fluid, a suction tube for drawing fluid from the receptacle and a U packing encircling the suction tube, the U packing being disposed operatively between the pump head and the storage receptacle, wherein, upon actuation of the spray pump to draw fluid from the receptacle, the suction tube undergoes a tilting in the U packing by the relative movement between the piston and the cylinder, and an air path to the storage receptacle is opened by the tilting, wherein said packing includes a sealing portion having a cup-shaped protuberance.

24. Hand lever-actuated spray pump comprising:

a pump chamber which has an inlet valve and an outlet valve, the chamber including a pump cylinder and a pump piston which interacts with the pump cylinder;

a lever-like actuating handle which is connected to the pump cylinder;

a suction tube which operatively communicates with the pump chamber;

wherein the pump cylinder is movable relative to the pump piston in order to carry out a pumping operation;

the pump further comprises a return spring providing a return relative motion between the pump piston and the pump cylinder;

a pump head enclosing the pump chamber, an outlet nozzle fixed in the pump head;

wherein the pump piston and the pump cylinder are arranged in axial extension of the outlet nozzle and are supported in the pump head; and the suction tube opens approximately at right angles to the axial extension of the pump cylinder and with each pumping operation axial movement of the pump cylinder is carried out, and the spring acts directly on the actuating handle.

25. A Spray pump according to claim 24, wherein the pump chamber is mounted in the pump head on one side in the outlet nozzle and on the other side in an axial extension of the outlet nozzle.

26. A spray pump having a pump head and being actuated by a hand-lever, comprising a pump chamber which is disposed in the head and has an inlet valve and an outlet valve, the chamber including a pump cylinder and a pump piston which are disposed between the inlet valve and the outlet valve, the pump piston cooperating with the pump cylinder;

a lever-like actuating handle for introducing a relative motion between the piston and the cylinder, a suction tube connecting with the chamber, and a return spring engaging the head and providing a restoring movement to the handle; wherein the actuating handle is pivotally mounted to the head and is formed as an actuating lever having a short lever arm and a long lever arm, the short lever arm acting on the pump cylinder or the pump piston; and the return spring is integrated with the actuating handle.

27. A spray pump having an actuatable pump chamber with an inlet valve and an outlet valve, the pump further comprising a storage container coupleable to the inlet valve, a sealing member, and a suction tube which passes sealingly through the sealing member to communicate with the container, the sealing member serving to seal off the storage container, wherein the suction tube is approximately perpendicular with respect to the pump chamber and is operatively connected to the pump chamber, the suction tube tilts in the sealing member upon actuation of the spray pump and thereby actuating the pump chamber, opening between the sealing member and the suction tube an air path to the storage container caused by the tilting of the suction tube relative to the sealing member.

28. A spray pump according to claim 27, further comprising an outlet nozzle, and a pump piston connecting with the inlet valve wherein the outlet valve connects between the outlet nozzle and the pump piston.

29. A spray pump according to claim 28 wherein the outlet nozzle has a first conical surface, the spray pump further comprises a nozzle insert operatively coupled to the outlet nozzle, and the nozzle insert has a second conical surface, the first and the second conical surfaces being identically directed.

30. A spray pump according to claim 29, wherein the conical surfaces open up towards an outlet of the outlet nozzle.

31. A spray pump according to claim 28, wherein the pump piston is movable towards the outlet nozzle in order to open the outlet valve.

32. A spray pump according to claim 27, wherein the sealing cuff comprises a sealing section with air channels, and a sealing region which rests directly against the suction tube.

33. Spray pump according to claim 27, wherein said sealing member comprises a first portion which encircles said tube and is provided with air passages extending through said first portion of said sealing member; and said sealing member comprises a second portion which encircles said tube, is contiguous to said first portion, and sealingly terminates said air passages in an absence of the tilting of said tube relative to said sealing member, said second portion of said sealing member permitting a flow of air in said passages upon the tilting of said tube relative to said sealing member.

34. A spray pump having a pump chamber with an inlet valve and an outlet valve, the pump further comprising a storage container coupled to the inlet valve and having a sealing member, and a suction tube which passes through the sealing member to communicate with the container, the sealing member serving to seal off the storage container, wherein, with a course of the suction tube which is approximately perpendicular to the pump chamber, the suction tube can be tilted in the sealing member upon actuation of the spray pump, and an air path to the storage container can be opened by a tilting of the suction tube;

wherein the sealing member comprises a sealing section with air channels, and a sealing region which rests directly against the suction tube; and wherein the sealing section has a sawtooth-shaped inner profile, there being tips of the profile and/or longitudinal edges of the sealing section resting against the suction tube.

35. A spray pump having a pump chamber with an inlet valve and an outlet valve, the pump further comprising a storage container coupled to the inlet valve and having a sealing member, and a suction tube which passes through the sealing member to communicate with the container, the sealing member serving to seal off the storage container, wherein, with a course of the suction tube which is approximately perpendicular to the pump chamber, the suction tube can be tilted in the sealing member upon actuation of the spray pump, and an air path to the storage container can be opened by a tilting of the suction tube;

wherein the sealing member comprises a sealing section with air channels, and a sealing region which rests directly against the suction tube; and the sealing section has a cup-shaped protuberance.

36. Spray pump, having a pump head and adapted to be mounted on a storage receptacle, and comprising a piston and a cylinder movable relative to each other within the head to express fluid, a suction tube for drawing fluid from the receptacle and a U packing encircling the suction tube, the U packing being disposed operatively between the pump head and the storage receptacle, wherein, upon actuation of the spray pump to draw fluid from the receptacle, the suction tube undergoes a tilting in the U packing by the relative movement between the piston and the cylinder, and an air path to the storage receptacle is opened by tilting, wherein said packing includes a sealing portion having a sawtooth inner profile including longitudinal edges resting against the suction tube.

* * * * *